United States Patent [19]

Gougeon

[11] Patent Number: 4,763,372

[45] Date of Patent: Aug. 16, 1988

[54] OSCILLATABLE TOOTHBRUSH

[76] Inventor: Robert J. Gougeon, C.P. 346, Matapédia, Québec, Canada, G0J 1V0

[21] Appl. No.: 44,714

[22] Filed: May 1, 1987

[51] Int. Cl.[4] ..... A46B 13/08

[52] U.S. Cl. ..... 15/22 R; 15/26

[58] Field of Search ..... 15/22 R, 26, 22 C; 132/34 R

[56] References Cited

U.S. PATENT DOCUMENTS 1,824,967 9/1931 Seelig ..... 15/26

FOREIGN PATENT DOCUMENTS 498587 9/1954 Italy ..... 15/26

*Primary Examiner*—Edward L. Roberts

*Attorney, Agent, or Firm*—Roland L. Morneau

[57] ABSTRACT

A toothbrush is provided with a handle having a mechanism for oscillating the bristles of the brush sideways. The mechanism comprises an elastic band stretch between the handle and the shaft of the toothbrush to retain their relative rotational orientation. It also comprises a plunger hingely mounted on the shaft of the toothbrush and off its longitudinal axis for producing a rotation of the toothbrush of about a quarter of a turn when depressed. The elastic band returns the mechanism to its original position when the plunger is released. This repeated action produces the oscillation of the bristles.

5 Claims, 2 Drawing Sheets

OSCILLATABLE TOOTHBRUSH

BACKGROUND OF THE INVENTION

Rotary toothbrushes have been contemplated in the past with complicated mechanisms such as U.S. Pat. Nos. 1,949,241 and 3,241,169.

Simplified mechanical arrangements were described by L. Bercovitz in Canadian Pat. No. 709,542 corresponding to U.S. Pat. No. 3,214,776. Bercovitz relies on a handle made of a one-piece bow member as crank arm to oscillate the toothbrush.

BRIEF SUMMARY OF THE INVENTION

The present invention relates to a toothbrush provided with a mechanism for producing an oscillating movement of the bristles. It provides a better and more complete cleaning action on the teeth. The present invention comprises a toothbrush having a handle axially disposed in a tubular casing. The handle is elastically retained to the casing in one angular orientation. A plunger is hingely fixed on the handle and extends outside the casing. The plunger is off-center relative to the axis of the handle and is adapted to produce a rotation of the handle about its axis. The elastic retention of the handle forces the handle to return to its original position. An elastic rubber band is foreseen to elastically retain the toothbrush. It is maintained under tension between a hook fixed to the casing and a second hook fixed to the toothbrush.

The casing is preferably provided with a cover to give easy access to the rubber band. It also allows the plunger to be rotated from one side to the other side of the handle and therefore permits the toothbrush to be manipulated by both the right hand and the left hand and on both sides of the teeth.

DETAILED DESCRIPTION OF THE INVENTION

Figure 2:
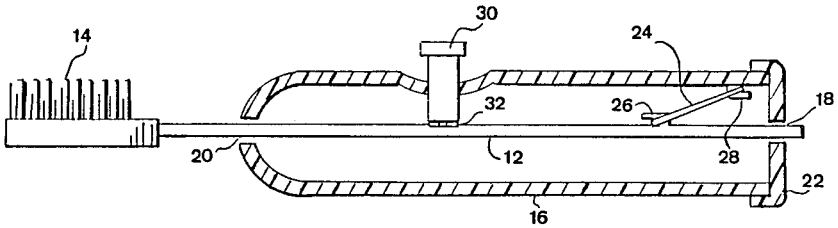
FIG. 2: is a side view of the toothbrush shown in FIG. 1 with the casing in cross-section.
Figure 3:
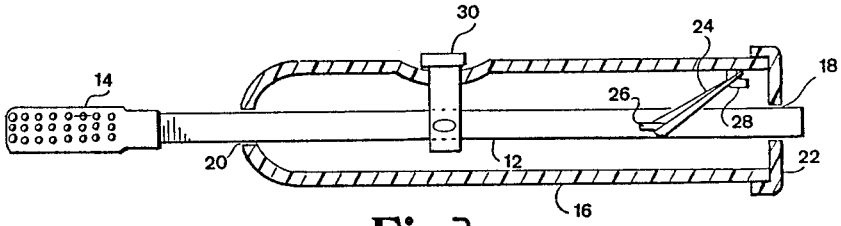
FIG. 3: is a side view as shown in FIG. 2 while the plunger is depressed.
Figure 4:
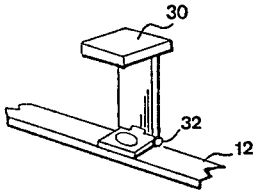
FIG. 4: is a view of the plunger hingely fixed to the toothbrush.
Figure 1:
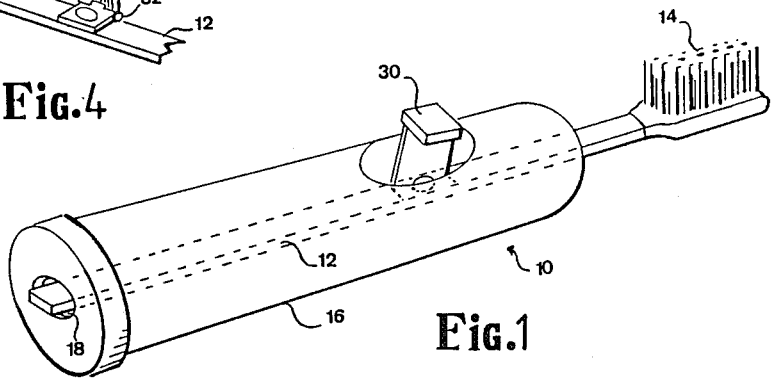
FIG. 1: is a perspective view of the toothbrush according to an embodiment of the invention.
Figure 6:
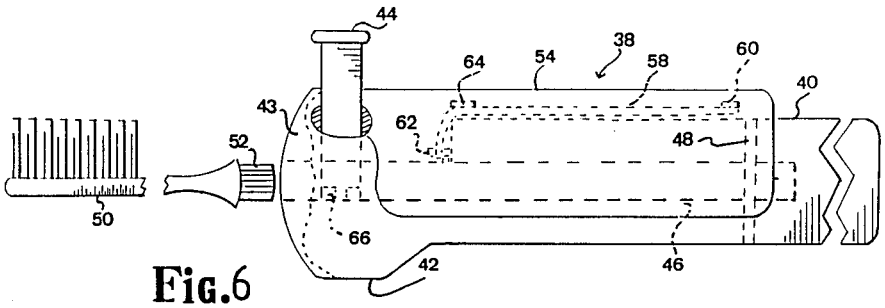
FIG. 6: is a side view of the embodiment shown in FIG. 5
Figure 7:
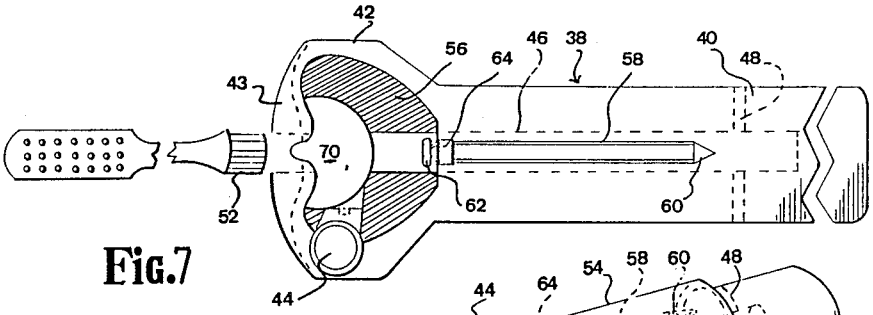
FIG. 7: is a top view of the embodiment shown in FIG. 5 with the cover removed.
Figure 5:
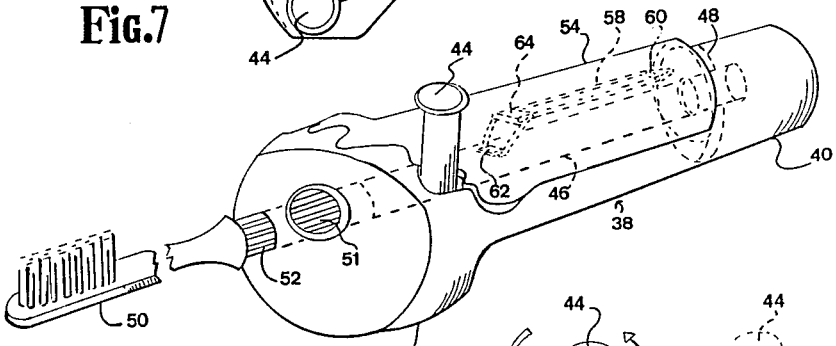
FIG. 5: is a perspective view of another embodiment of the invention.
Figure 8:
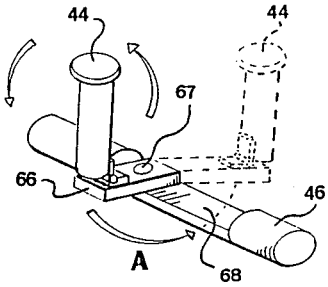
FIG. 8: is a detailed perspective view of the plunger shown in FIG. 5.

The toothbrush 10 shown in FIGS. 1–3 comprises a flat handle 12 having the usual bristles 14 at one end. The handle 12 is axially mounted in a casing 16 and protrudes at both ends thereof through circular openings 18 and 20. The rear end of the casing 16 has a removable cover 22 to provide access inside the casing 16. The handle 12 is maintained in a stable rotational position by an elastic rubber band 24 held to the handle 12 by a hook 26 and to the casing 16 by hook 28. A plunger 30 is hingely fixed to the handle 12. As illustrated in FIG. 4, the plunger 30 is connected to the handle 12 by hinge 32 which is secured to a flat surface of the handle and off its axis.

In operation, when the plunger 30 is depressed, the handle 12 and the bristles 14 are rotated sideways about a quarter of a turn. The elastic band 24 becomes under tension and when the pressure on the plunger is released, the elastic band brings back the handle and bristles in their original position. When the toothbrush is moved longitudinally over the teeth, the actuation of the plunger simultaneously creates an up and down brushing effect on the teeth. This combination of movements corresponds to the recommended procedure for brushing teeth.

In the embodiment illustrated in FIGS. 5 to 8, the casing 38 has a rear tubular section 40 and a front portion 42 with an enlarged cross-section for housing the mechanism of the plunger 44. A shaft 46 extends through the channel formed by the tubular section 40 and the front portion 42. The shaft 46 is freely supported by the thick front wall 43 of the front portion 42 and by a rear partition 48 so as to enable the shaft 46 to rotate freely when actuated by the plunger 44. The brush 50 ends with a groove stub 52 which fits into a corresponding socket 51 inside the front part of the shaft 46 adapted to rotate in the front wall 43. The upper part of the casing 40 is covered by a sliding member 54 which is adapted to cover the elastic band and the enclosure 56 which houses the mechanism of the plunger 44. The elastic band 58 is held at one end to a hook 60 fixed on the surface of the casing 40 and at the other end to a hook 62 fixed to the rod 46. A guide element 64 is fixed on the upper and forward surface of the casing 40. The band 58 which is stretched between and around hooks 60 and 62 is prevented from sliding sideways by the guide element 64.

The plunger 44 is connected to the shaft 46 by a hinge member 66. When the plunger 44 is depressed, the shaft 46 is rotated and the brush 50 is turned sideways. This rotation stretches the elastic band 58 between hooks 60 and 62 but is kept centered by the guide element 64. When the pressure on the plunger 44 is released, the elastic band 58 returns the shaft 46 and the brush in their original position such as in FIG. 6.

The plunger 44 can be rotated around the axle 67 in the direction of the arrow A over a flattened portion 68 of the shaft 46. The plunger moves from one side to the other side of the shaft 46. When the plunger has reached the position 44', indicated in dotted lines in FIG. 8, the brush 50 will rotate sideways in the other direction when the plunger is depressed. Each of these positions of the plunger is intended to facilitate its actuation by the thumb of each hand and to brush the teeth from both sides. A semi-circular tab 70 is secured to the casing at an upper level of the enclosure 56 to guide the plunger 44 during its movement from one side of the shaft 46 to the other side i.e. from position 44 to 44'.

The embodiment shown in FIGS. 5 to 8 facilitates an easier a more complete brushing of the teeth. The sliding cover 54 in addition to allow the plunger 44 to move from one side of the shaft 46 to the other, gives an easy access to the mechanism of the plunger 44 and to the elastic band 58 which must be changed at times.

Another advantage of this embodiment permits the same casing to be used for different toothbrushes i.e. for more than one user.

It should be obvious that a spring could be substituted for the elastic band without changing the substance of the invention.

I claim:

1. An oscillatable toothbrush handle comprising an elongated tubular casing enclosing a shaft for supporting a toothbrush, said casing having a perforated front and rear wall for supporting said shaft and adapted to allow rotation of said shaft about its longitudinal axis, resilient means extending between said casing and said shaft for maintaining said shaft and a predetermined rotational orientation, plunger means hingely fixed to said shaft and extending outside said casing for rotating said shaft around its longitudinal axis about a quarter of a turn, said resilient means biassing said shaft back in said predetermined orientation when said plunger means is released.

2. A toothbrush handle as recited in claim 1, wherein the resilient means comprises an elastic band hooked at one end to said casing and at the other end to the said shaft.

3. A toothbrush handle as recited in claim 1, wherein said plunger means is rotatably connected to said shaft for rotation about an axis perpendicular to said shaft, the said plunger means being displaceable from one side to the other side of the shaft.

4. A toothbrush handle as recited in claim 1, wherein the part of the shaft adjacent the front wall is a ribbed hollow socket adapted to receive a toothbrush.

5. An oscillatable toothbrush comprising a toothbrush having a handle, a tubular casing having a front and rear wall for enclosing and supporting said handle about its longitudinal axis, elastic means fixed to said handle and to said casing inside the latter for maintaining said handle in a predetermined rotational orientation, hinge means connected to said handle said hinge means having an axle eccentrically mounted relative to the axis of said handle, manually operated plunger means extending through said casing and connected to the hinge means for actuating said hinge means and causing said handle to rotate about a quarter of a turn about said axle, said elastic means biassing said handle back to said predetermined orientation when said plunger means is released.

* * * * *